US006336284B1

(12) United States Patent
Rotell, III et al.

(10) Patent No.: US 6,336,284 B1
(45) Date of Patent: Jan. 8, 2002

(54) SURE SHOT MUZZLE LOADER

(76) Inventors: Anthony J. Rotell, III, 200 Thomas St., Jessup, PA (US) 18434; Richard B. Pazzalia, 1532 Main St.; Alan Gerek, 737 Main St., both of Peckville, PA (US) 18452

( * ) Notice: Subject to any disclaimer, the term of this patent is extended or adjusted under 35 U.S.C. 154(b) by 0 days.

(21) Appl. No.: 09/562,078

(22) Filed: May 1, 2000

(51) Int. Cl.[7] ..... F41C 27/00
(52) U.S. Cl. ..... 42/90; 42/90; 42/95
(58) Field of Search ..... 42/90, 51, 106, 42/95

(56) References Cited

U.S. PATENT DOCUMENTS

| | | | | | |
|---|---|---|---|---|---|
| 2,544,847 | A | * | 3/1951 | Malesky | 42/95 |
| 4,050,175 | A | | 9/1977 | Mulinix | |
| 4,152,858 | A | | 5/1979 | Dobbs | |
| 4,327,515 | A | | 5/1982 | Kuryn | |
| 4,373,285 | A | * | 2/1983 | Grout et al. | 42/90 |
| 4,536,983 | A | | 8/1985 | Fry | |
| 4,550,517 | A | | 11/1985 | Mansfield | |
| 4,601,125 | A | | 7/1986 | Curtis | |
| 4,862,623 | A | | 9/1989 | Delap et al. | |
| 4,875,303 | A | | 10/1989 | Deweert et al. | |
| 4,890,406 | A | | 1/1990 | French | |
| 4,974,357 | A | | 12/1990 | Jones et al. | |
| 5,016,380 | A | | 5/1991 | Jones | |
| 5,097,615 | A | | 3/1992 | Kearns | |
| 5,417,004 | A | | 5/1995 | Krantz | |
| 5,446,987 | A | | 9/1995 | Lee et al. | |
| 5,836,099 | A | | 11/1998 | Pace et al. | |
| 6,085,450 | A | * | 7/2000 | Caudle | 42/90 |
| 6,145,235 | A | * | 11/2000 | Emerson et al. | 42/95 |

FOREIGN PATENT DOCUMENTS

| | | | | |
|---|---|---|---|---|
| AT | 143673 | | 1/1954 | |
| CH | 0618-786 | * | 8/1980 | 42/95 |
| EP | 0 282 438 A1 | | 12/1988 | |
| FR | 1146903 | | 11/1957 | |

* cited by examiner

*Primary Examiner*—Michael J. Carone
*Assistant Examiner*—Lulit Semunegus
(74) *Attorney, Agent, or Firm*—Richard C. Litman

(57) ABSTRACT

A device for quickly loading a muzzle-loaded firearm comprises a casing having a stepped bore disposed therethrough. The stepped bore includes a small diameter portion and a large diameter portion. An adjustment rod has a rear end threaded into the small diameter portion. The front end of the adjustment rod is formed with a bore to accommodate a surface portion of a bullet. A locknut is provided to lock the adjustment rod at a pre-determined setting in the casing. The device is used, in a first position, to initially insert the bullet into the barrel of the firearm. In a second position the device is used in conjunction with a ramrod to position a bullet/powder charge at the optimum firing depth in the barrel.

10 Claims, 3 Drawing Sheets

SURE SHOT MUZZLE LOADER

BACKGROUND OF THE INVENTION

1. Field of the Invention

The present invention generally relates to muzzle-loading firearms. More specifically, the present invention is drawn to a tool for quickly inserting a bullet/powder charge to the correct depth in a muzzle-loading firearm.

2. Description of the Related Art

A muzzle-loading firearm, as indicated by its name, is a type of firearm which is loaded through its barrel. To ensure accuracy in firing, it is very important that successive bullet (sabot, ball, etc.) and powder (black powder, PYRODEX, etc.) charges are inserted to the same depth in the firearm's barrel each time. A tool for performing this function quickly and accurately would be a welcome addition in the art.

There are many patents which disclose devices for assisting the loading of muzzle-loading firearms. For example U.S. Pat. No. 4,050,175 (Mulinix), U.S. Pat. No. 4,152,858 (Dobbs), U.S. Pat. No. 4,536,983 (Fry), U.S. Pat. No. 4,550,517 (Mansfield), U.S. Pat. No. 4,601,125 (Curtis), U.S. Pat. No. 4,862,623 (Delap et al.), U.S. Pat. No. 4,875,303 (DeWeert et al.), U.S. Pat. No. 4,974,357 (Jones et al.), U.S. Pat. No. 5,016,380 (Jones), and U.S. Pat. No. 5,097,615 (Kearns) disclose starting devices for inserting a bullet/powder charge in the barrel of a muzzle-loading firearm wherein the charge is further inserted to a firing depth by a ramrod. However, the instant patents fail to show structure on the devices for accurately determining that the initial charge and successive charges will be inserted to an optimum firing depth.

U.S. Pat. No. 4,327,515 (Kuryn) and European Patent number 0 282 438 A1 show respective devices for accurately determining the depth of a bullet/powder charge in a barrel. The devices however lack means for adjusting the depth determining feature to accommodate firearms which may require more or less depth for accurate firing.

U.S. Pat. No. 4,890,406 (French), U.S. Pat. No. 5,836,099 (Pace et al.); Austrian Patent number 143,673, and French Patent number 1,146,903 disclose ramrod structure.

U.S. Pat. No. 5,417,004 (Krantz) and U.S. Pat. No. 5,446,987 (Lee et al.) are concerned with the insertion of hollow-point bullets. The patents do not disclose structure to ensure optimum depth for successive loaded bullets.

None of the above inventions and patents, taken either singularly or in combination, is seen to disclose a tool for loading and positioning a bullet/powder charge in a muzzle-loading firearm as will be subsequently described and claimed in the instant invention.

SUMMARY OF THE INVENTION

The instant invention is an uncomplicated device to enhance the loading and proper positioning of a bullet/powder charge in the barrel of a muzzle-loading firearm. The invention is simplistic in that it consists of only three parts; a cylindrical casing, an adjustment rod and a locknut. When assembled, the three parts form an elongated tool. One end of the tool is used to insert a bullet into the barrel of a firearm. The other end of the tool is then employed in conjunction with a ramrod to ensure that the bullet: and powder are inserted to the optimum firing depth for the particular firearm. The tool is adjustable so that it may be utilized with other muzzle-loading firearms which may have different optimum firing depths.

Accordingly, it is a principal object of the invention to provide a device to enhance loading of muzzle-loading firearms.

It is another object of the invention to provide a device that ensures that successive bullet/powder charges are positioned at the same depth in the barrel of muzzle-loading firearms.

It is a further object of the invention to provide a device that has an adjustment feature such that the depth position of the bullet/powder charge may be varied to accommodate different types of muzzle-loading firearms.

Still another object of the invention is to provide a device to enhance loading of a muzzle-loading firearm, which device is simplistic in construction and easy to use.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Attention is directed to FIGS. 3–6 of the illustrations wherein the device of the present invention is generally indicated at 10. The device comprises a casing 12, an adjustment rod 14, and a locknut 16. The device is shown in its assembled state in FIG. 3.

Adjustment rod 14 (FIG. 4) is approximately seven inches long and has a first end formed with a one-quarter inch bore 14*a*. Bore 14*a* has a sixty degree chamfer 14*b* at the end and extends approximately one-half of an inch into the rod. A second end of rod 14 has threads 14*c* disposed thereon. Threads 14*c* extend approximately four inches along the exterior surface of rod 14.

Casing 12 (FIG. 5) has a cylindrical configuration and is fashioned with an internal stepped bore. Casing 12 has a one-inch diameter and a length of approximately four and one-half inches. The smaller diameter bore 12*a* is threaded to receive threads 14*c* of rod 14. The larger diameter bore 12*b* has a diameter of one-half inch and extends approximately four inches into the casing.

Figure 6:
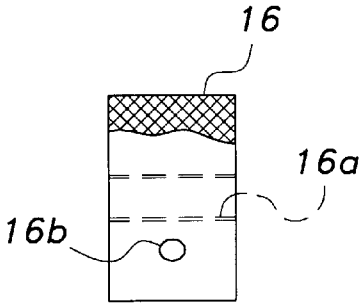
FIG. 6 is a plan view of the locknut of a Sure Shot Muzzle Loader according to the present invention.

As best seen in FIG. 6, locknut 16 has a one-inch diameter and is one-half of an inch wide. Locknut 16 is provided with a medium knurl and a threaded bore 16*a*. The threads of bore 16*a* are adapted to receive threads 14*c* of rod 14. A conventional set screw 16*b* is positioned on locknut 16 for reasons as will be explained below.

The device 10 is assembled and used as follows. The threaded end 14*c* of rod 14 is inserted (threaded) through locknut 16 and into bore 12*a* of casing 12. The distance that rod 14 is threaded into bore 12*a* is pre-determined by the depth that a bullet/powder charge must be positioned in the barrel of a firearm as will be shown below. After the rod has been positioned in bore 12*a*, screw 16*b* is tightened to fix rod 14 in the pre-determined position.

Figure 1:
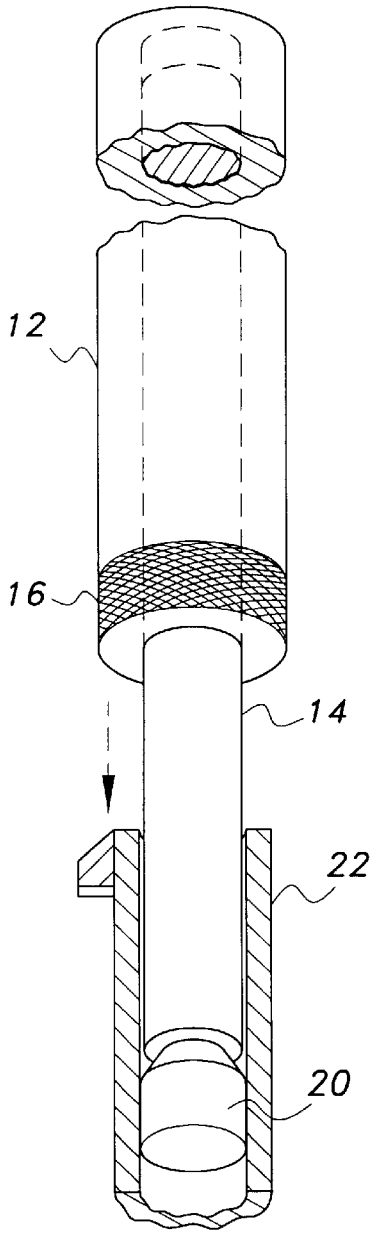
FIG. 1 is an environmental view of a Sure Shot Muzzle Loader in the starter position according to the present invention.
Figure 2:
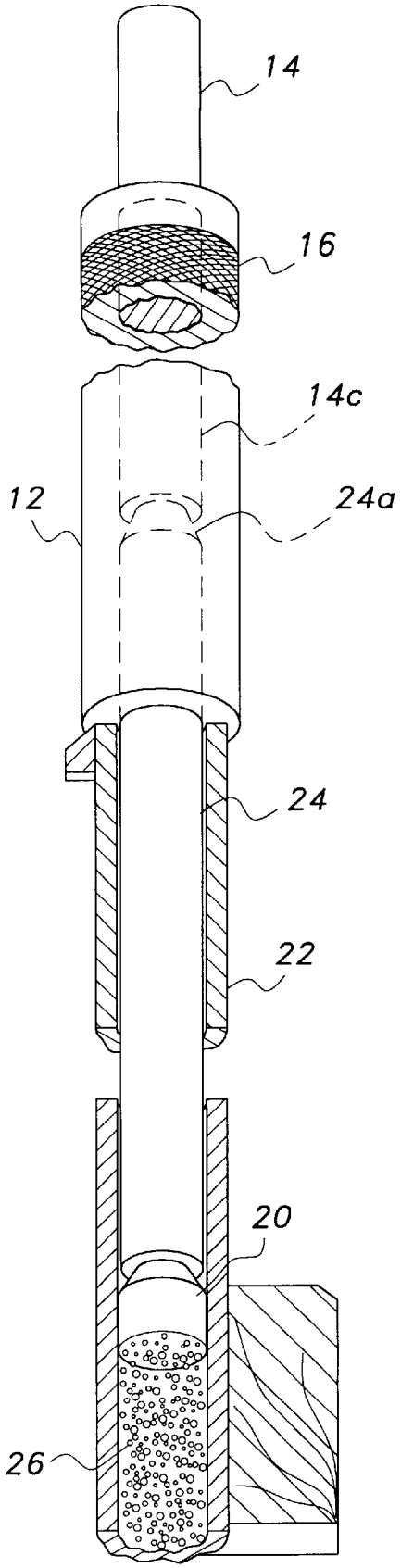
FIG. 2 is an environmental view of a Sure Shot Muzzle Loader in the tamping position according to the present invention.
Figure 3:
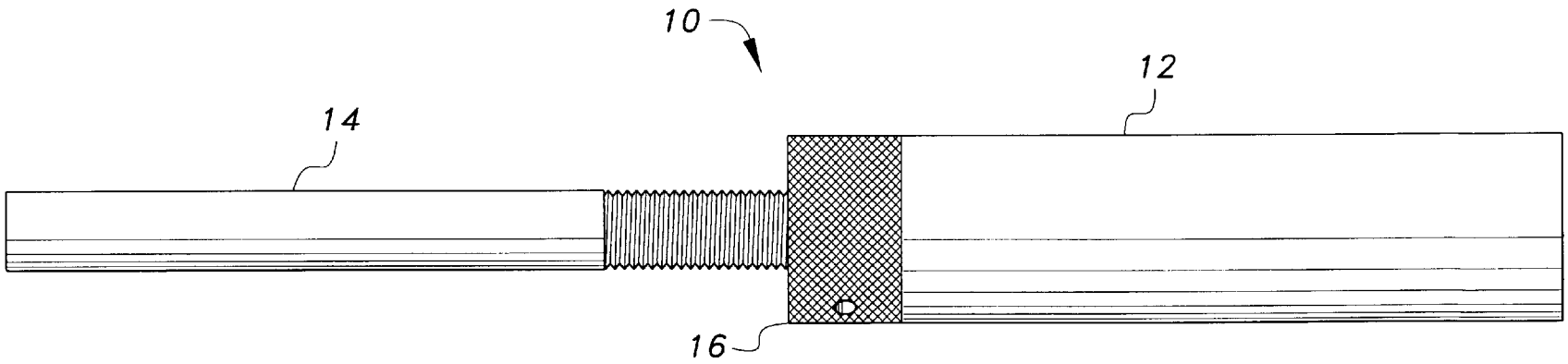
FIG. 3 is a plan view of the assembled Sure Shot Muzzle Loader according to the present invention.
Figure 4:
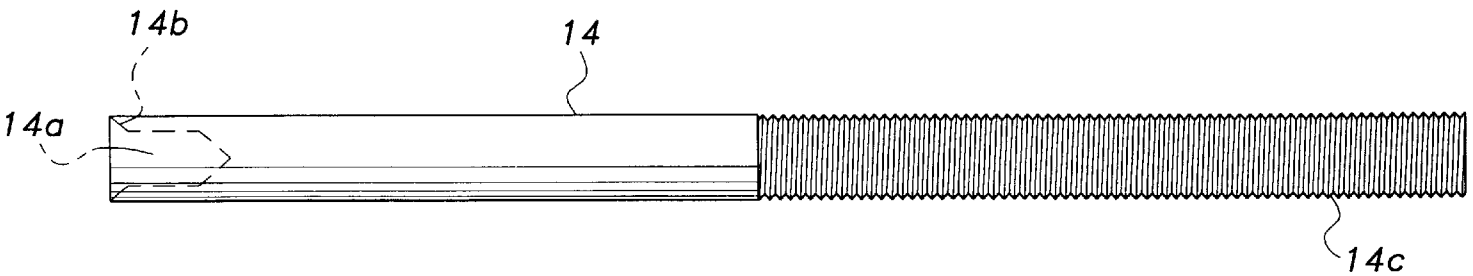
FIG. 4 is a plan view of the adjustment rod of a Sure Shot Muzzle Loader according to the present invention.
Figure 5:
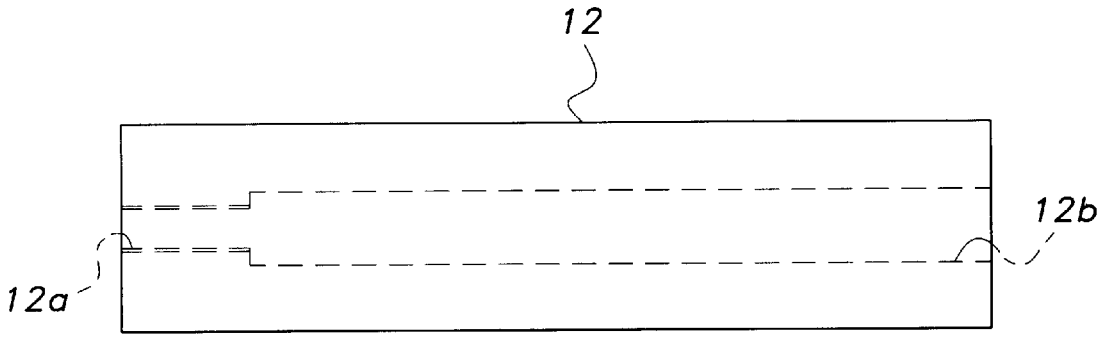
FIG. 5 is a plan view of the casing of a Sure Shot Muzzle Loader according to the present invention.

Attention is now directed to FIG. 1 which shows the device 10 utilized in its starter mode. A bullet 20 is partially inserted in bore 14*a*. The device is then employed to initially push the bullet into the barrel 22 of a muzzle-loaded firearm. It is noted that the powder charge 26 (FIG. 2) is disposed in the barrel before the bullet is inserted. The device is not needed for the insertion of the powder. After bullet 20 is initially inserted in the barrel 22, a ramrod 24 (FIG. 2) is inserted in the barrel. Device 10 is flipped over so that the larger bore 12*b* of casing 12 is positioned over end 24*a* of ramrod 24. End 24*a* will be in abutment with the threaded end 14*c* of rod 14. Device 10 (and consequently ramrod 24) is then pushed downwardly until casing 12 abuts barrel 22. Since rod 14 has been pre-set based on the type of firearm, the bullet/powder charge will be positioned at the identical depth in the barrel upon each successive loading when using the device 10.

If a different type of firearm is used, rod 14 can be adjusted to position the bullet/powder charge at the appropriate depth for accurate firing. The casing, adjustment rod and locknut can be fabricated from any durable and suitable materials such as plastic or metal. The dimensions of the device will allow it to be worn around the neck of a user for easy access if a cord or strap is attached to the device.

It is to be understood that the present invention is not limited to the embodiment described above, but encompasses any and all embodiments within the scope of the following claims.

We claim:

1. A device for quickly loading a muzzle-loading firearm, said device comprising:

a casing, said casing having a first end and a second end;

a first bore extending through said casing, said first bore opening at said first end and said second end;

an adjustment rod, said adjustment rod having an outer surface, a front end and a rear end;

a second bore disposed in said front end of said adjustment rod;

threads formed on said outer surface of said adjustment rod at said rear end; and means for connecting and locking said rear end of said adjustment rod to said casing.

2. The device as defined in claim 1, wherein said first bore is a stepped bore having a small diameter portion and a large diameter portion.

3. The device as defined in claim 2, wherein said means for connecting and locking includes threads disposed on said small diameter portion.

4. The device as defined in claim 3, wherein said means for connecting and locking includes a locknut disposed on said rear end of said adjustment rod.

5. The device as defined in claim 4, wherein said casing is cylindrically shaped.

6. The device as defined in claim 5, wherein said casing has a length of approximately four and one-half inches and an external diameter of approximately one inch.

7. The device as defined in claim 6, wherein said large diameter portion has a diameter of approximately one-half of an inch.

8. The device as defined in claim 7, wherein said adjustment rod has a length of approximately seven inches.

9. The device as defined in claim 8, wherein said casing, said adjustment rod and said locknut are fabricated from a plastic material.

10. The device as defined in claim 8, wherein said casing, said adjustment rod and said locknut are fabricated from a metallic material.

* * * * *